US007281905B2

(12) United States Patent
Saiki et al.

(10) Patent No.: US 7,281,905 B2
(45) Date of Patent: Oct. 16, 2007

(54) PISTON TYPE COMPRESSOR

(75) Inventors: Akio Saiki, Kariya (JP); Noriyuki Shintoku, Kariya (JP); Nobutoshi Banno, Kariya (JP); Jun Kondo, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 815 days.

(21) Appl. No.: 10/796,722

(22) Filed: Mar. 9, 2004

(65) Prior Publication Data

US 2004/0179948 A1 Sep. 16, 2004

(30) Foreign Application Priority Data

Mar. 13, 2003 (JP) ..... 2003-068475

(51) Int. Cl.
*F04B 1/12* (2006.01)

(52) U.S. Cl. ..... 417/269

(58) Field of Classification Search ..... 417/269, 417/222.1, 222.2; 62/507
See application file for complete search history.

(56) References Cited

U.S. PATENT DOCUMENTS 4,321,019 A * 3/1982 Degawa et al. ..... 417/269
5,207,078 A 5/1993 Kimura et al.
6,296,457 B1 * 10/2001 Shintoku et al. ..... 417/312
2001/0041142 A1 * 11/2001 Kimura et al. ..... 417/269
2003/0146053 A1 * 8/2003 Shintoku et al. ..... 184/6.16

FOREIGN PATENT DOCUMENTS

JP 5-66066 3/1993
JP 07-063165 3/1995
JP 2002-070728 3/2002

* cited by examiner

*Primary Examiner*—Anthony Stashick
*Assistant Examiner*—Vikansha Dwivedi
(74) *Attorney, Agent, or Firm*—Knoble Yoshida & Dunleavy, LLC

(57) ABSTRACT

In a piston type compressor, a housing includes a cylinder head which defines a discharge chamber and a cooling chamber. The cooling chamber located adjacent to the discharge chamber surrounds the discharge chamber. The housing also defines a suction chamber, a compression chamber, and a crank chamber. The cooling chamber is isolated from the suction chamber. Gas is introduced from outside of the housing into the suction chamber. A rotary shaft is rotatably supported in the housing. The cam is accommodated in the crank chamber. A piston is operatively coupled to the rotary shaft through the cam. Rotation of the rotary shaft is converted to reciprocation of the piston. A seal member shuts communication between the cooling chamber and an atmosphere outside the compressor to seal an inside of the cylinder head. An introducing passage interconnects the cooling chamber and the crank chamber.

14 Claims, 5 Drawing Sheets

PISTON TYPE COMPRESSOR

BACKGROUND OF THE INVENTION

The present invention relates to a piston type compressor having a housing which includes a cylinder head defining a discharge chamber, and a seal member for sealing an inside of the cylinder head, and more particularly to a piston type compressor having a housing which defines a suction chamber and a crank chamber accommodating a cam for converting rotation of a rotary shaft to reciprocation of a piston, wherein gas introduced from the suction chamber into a compression chamber is compressed and discharged to the discharge chamber in conjunction with the reciprocation of the piston.

A piston type compressor for use in a vehicle air conditioner includes a double-headed type piston, as disclosed in Unexamined Japanese Patent Publication No. 7-63165. As shown in FIG. 5, the piston type compressor includes a front cylinder head 101 and a rear cylinder head 102. The front cylinder head 101 defines a discharge chamber 111A. The rear cylinder head 102 defines a suction chamber 112 and a discharge chamber 111B. The piston type compressor further includes a pair of cylinder blocks 104A, 104B. The front cylinder head 101 and the rear cylinder head 102 are connected to the cylinder blocks 104A, 104B through gaskets 103A, 103B, respectively. Namely, the front cylinder head 101, the rear cylinder head 102 and the cylinder blocks 104A, 104B cooperate to form a housing of the piston type compressor. Front compression chambers 113A are defined in the front cylinder block 104A by pistons 114. Rear compression chambers 113B are defined in the rear cylinder block 104B by the pistons 114.

Radially outer portions 103*a* of the respective gaskets 103A, 103B seal the discharge chambers 111A, 111B from the atmosphere outside the compressor at respective joints between the cylinder heads 101, 102 and the cylinder blocks 104A, 104B.

Suction valve devices 115A, 115B for the front and rear compression chambers 113A, 113B are provided by rotary valves 117A, 117B, respectively. The rotary valves 117A, 117B are formed in a rotary shaft 116 in such a manner that a gas passage between the respective compression chambers 113A, 113B and the suction chamber 112 is opened and closed alternately by rotation of the rotary shaft 116. Part of the gas passage is formed by an axial passage 116*a* which extends axially in the rotary shaft 116. Refrigerant gas is introduced from an external refrigerant circuit into the suction chamber 112 in the rear cylinder head 102. The refrigerant gas in the suction chamber 112 is then drawn into the front and rear compression chambers 113A, 113B through the axial passage 116*a* of the rotary shaft 116 and the rotary valves 117A, 117B, respectively.

It is noted that the piston type compressor has the suction chamber 112 formed in the middle portion of the rear cylinder head 102, surrounded by the discharge chamber 111B, for the purpose of simplifying the structure of connection between the axial passage 116*a* and the suction chamber 112.

In the above-described piston type compressor, the outer sealing portions 103*a* of the gaskets 103A, 103B at the respective joints between the cylinder heads 101, 102 and the cylinder blocks 104A, 104B are exposed to a large pressure difference between high pressure of refrigerant gas in the discharge chambers 111A,111B and the low atmospheric pressure. Accordingly, the outer sealing portions 103*a* of the gaskets 103A, 103B should have sufficient heat and pressure resistance in order to prevent the refrigerant gas from leaking out from the discharge chambers 111A, 111B, which leads to increased manufacturing cost.

Particularly, in the piston type compressor disclosed in the Unexamined Japanese Patent Publication No. 7-63165 in which the rotary valves 117A, 117B serve as the suction valve devices 115A, 115B, respectively, the refrigerant gas from the external refrigerant circuit is distributed to the front and rear rotary valves 117B, 117A through the suction chamber 112 which is formed in the rear cylinder head 102. Accordingly, the front compression chambers 113A are located farther from the suction chamber 112 than the rear compression chambers 113B.

Thus, the front compression chambers 113A tends to be short of the refrigerant gas to be introduced into the front compression chambers 113A thereby to increase compression ratio, so that temperature of the refrigerant gas discharged to the discharge chamber 111A rises in comparison to that of the refrigerant gas discharged to the discharge chamber 111B. As a result, the outer sealing portion 103*a* of the gasket 103A for shutting communication between the front discharge chamber 111A and the atmosphere tends to be more susceptible to the influence of heat than the similar outer sealing portion 103*a* of the gasket 103B for the rear discharge chamber 111B. Therefore, there is a need for providing a piston type compressor that reduces a load on a seal member for sealing the cylinder head of the compressor.

SUMMARY OF THE INVENTION

In accordance with the present invention, a piston type compressor has a housing, a rotary shaft, a cam, a piston, a seal member and an introducing passage. The housing includes a cylinder head which defines a discharge chamber and a cooling chamber. The cooling chamber located adjacent to the discharge chamber surrounds an outer circumference of the discharge chamber. The housing also defines a suction chamber, a compression chamber, and a crank chamber. The cooling chamber is isolated from the suction chamber. Gas is introduced from outside of the housing into the suction chamber. The rotary shaft is rotatably supported by the housing. The cam is accommodated in the crank chamber. The piston is operatively coupled to the rotary shaft through the cam. Rotation of the rotary shaft is converted to reciprocation of the piston. The seal member shuts communication between the cooling chamber and an atmosphere outside the compressor to seal an inside of the cylinder head. The introducing passage interconnects the cooling chamber and the crank chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment of the present invention will now be described with reference to FIGS. 1 through 2. The present invention is applicable to a fixed displacement double-headed piston type compressor (hereinafter, the compressor) that forms a part of a refrigerant circuit of a vehicle air conditioner. The left and right sides of the compressor correspond to the front and rear sides thereof, respectively.

Figures 1, 1A:
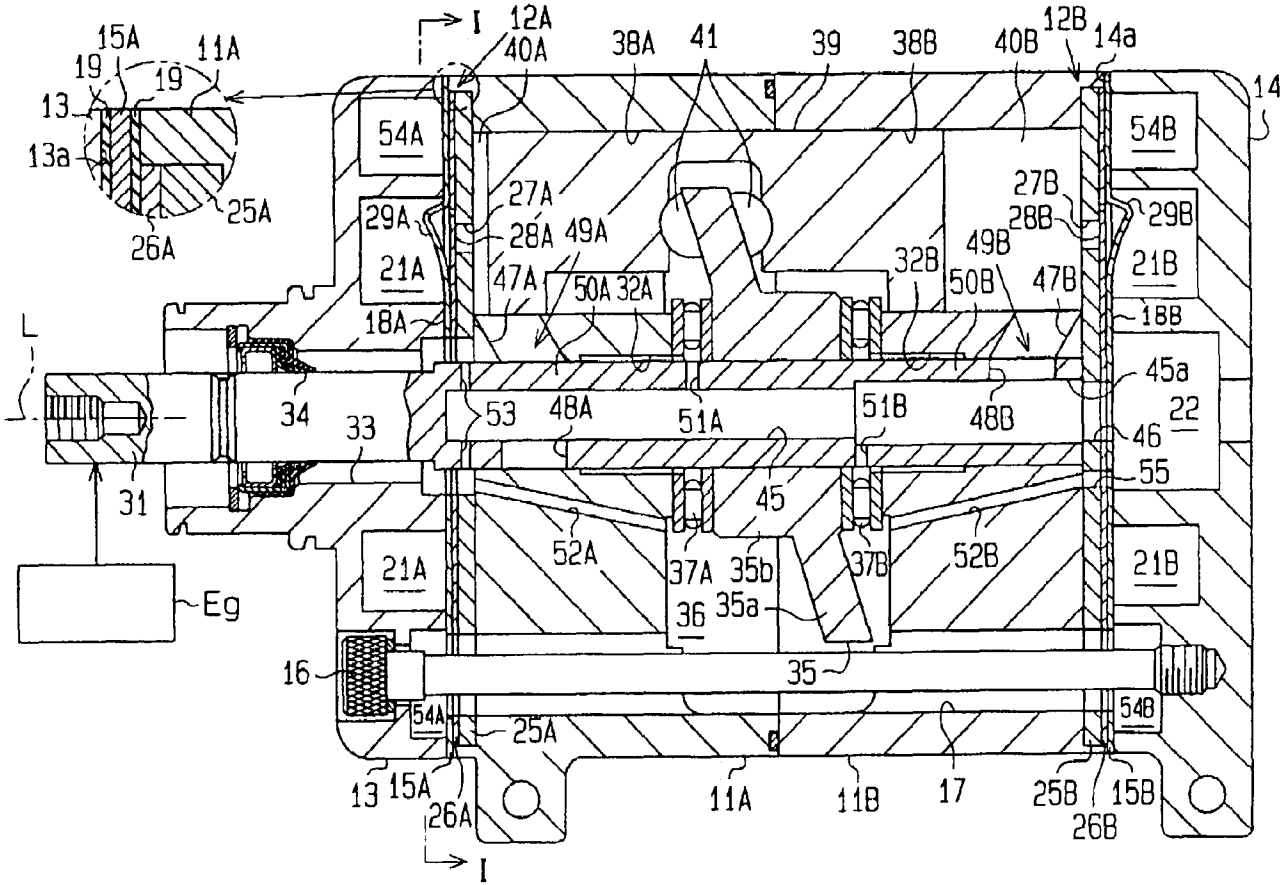
FIG. 1 is a schematic longitudinal cross-sectional view of a piston type compressor according to a first preferred embodiment of the present invention.
FIG. 1A is a partially enlarged cross-sectional view of FIG. 1.

As shown in FIG. 1, the compressor has a housing which includes a pair of front and rear cylinder blocks 11A, 11B, a front housing 13 and a rear housing 14. The front housing 13 serves as a front cylinder head located on a first end of the housing. The rear housing 14 serves as a rear cylinder head located on a second end of the housing. The front housing 13 is connected to the front end of the cylinder block 11A through a front valve port assembly 12A. The rear housing 14 is connected to the rear end of the cylinder block 11B through a rear valve port assembly 12B.

Thus, the housing of the compressor provides housing components which include the cylinder blocks 11A, 11B, the front housing 13 and the rear housing 14. These housing components are fastened together by a plurality of through bolts 16, as shown in FIG. 2.

The front valve port assembly 12A includes a retainer plate 15A, a discharge valve plate 26A and a valve port plate 25A which are layered in this order as seen from the front housing 13 toward the front cylinder block 11A. Similarly, the rear valve port assembly 12B includes a retainer plate 15B, a discharge valve plate 26B and a valve port plate 25B which are layered in this order as seen from the rear housing 14 toward the rear cylinder block 11B. The housing of the compressor forms a plurality of through holes 17 extending through the cylinder blocks 11A, 11B, the valve port plates 25A, 25B, the discharge valve plates 26A, 26B and the retainer plates 15A, 15B for receiving the bolts 16.

A discharge chamber or a first discharge chamber 21A is defined in the front housing 13. More specifically, the discharge chamber 21A is defined by connecting front end surface 18A of the retainer plate 15A and end surface 13*a* of the front housing 13. A discharge chamber or a second discharge chamber 21B and a suction chamber 22 are defined in the rear housing 14. That is, the discharge chamber 21B and the suction chamber 22 are defined by connecting rear end surface 18B of the retainer plate 15B and end surface 14*a* of the rear housing 14.

Seal members 19 are provided on both sides of the front and rear retainer plates 15A, 15B, respectively, so as to seal the slight clearance between the cylinder blocks 11A, 11B and adjacent housings 13, 14 of the respective cylinder blocks 11A, 11B. Incidentally, only the seal member 19 on the side of the retainer plate 15A is illustrated in FIG. 1A. The seal member 19 on the side of the retainer plate 15B is not illustrated.

Discharge ports 27A, 27B are formed in the valve port plates 25A, 25B, respectively. Discharge valves 28A, 28B are formed in the discharge valve plates 26A, 26B, which open and close the discharge ports 27A, 27B, respectively. Retainers 29A, 29B are formed in the retainer plate 15A, 15B for regulating the opening of the discharge valves 28A, 28B, respectively.

A rotary shaft 31 is rotatably supported by the cylinder blocks 11A, 11B with the front end thereof operatively coupled to an engine Eg. That is, the rotary shaft 31 is rotatably supported by the housing. The rotary shaft 31 is inserted through shaft holes 32A, 32B which extend through the center of the cylinder blocks 11A, 11B, and directly supported by the cylinder blocks 11A, 11B through the shaft holes 32A, 32B.

The front end portion of the rotary shaft 31 protrudes from the housing of the compressor through a hole 33 which is formed through the font housing 13, the retainer plate 15A, the valve port plate 25A and the discharge valve plate 26A. A shaft seal member 34 is interposed in the through hole 33 between the front housing 13 and the rotary shaft 31. Incidentally, the discharge chamber 21A forms an annular shape around the through hole 33 and is located adjacent to the through hole 33.

A cam 35 is fixedly connected to the rotary shaft 31 and is accommodated in a crank chamber 36 which is defined between the cylinder blocks 11A, 11B. The cam 35 includes a swash plate 35*a* disposed at a fixed inclination angle with respect to a plane perpendicular to the axis L of the rotary shaft 31. As shown in FIG. 1, the swash plate 35*a* is provided in sliding contact with hemispherical shoes 41.

A thrust bearing 37A is interposed between the front end surface of annular proximal portion 35*b* of the cam 35 and the rear end surface of the cylinder block 11A. Another thrust bearing 37B is interposed between the rear end surface of the proximal portion 35*b* of the cam 35 and the front end surface of the cylinder block 11B. The rotary shaft 31 is positioned in the direction of the axis L by a pair of the thrust bearings 37A, 37B.

A plurality of cylinder bores 38A is defined in the cylinder block 11A around the axis L of the rotary shaft 31. Similarly, a plurality of cylinder bores 38B is defined in the cylinder block 11B around the axis L. It is noted that only one pair of cylinder bores 38A, 38B is shown in FIG. 1 Each of the paired cylinder bores 38A, 38B slidably accommodates a double-headed piston 39. The double-headed pistons 39 define compression chambers 40A, 40B in the respective cylinder bores 38A, 38B. The compression chambers 40A, 40B correspond to a first compression chamber and a second compression chamber, respectively.

The rotation of the rotary shaft 31 is converted to the reciprocation of the double-headed piston 39 through the cam 35 which rotates with the rotary shaft 31. Namely, the rotation of the cam 35 is transmitted to the double-headed piston 39 through the shoes 41, so that the double-headed piston 39 reciprocates in the paired cylinder bores 38A, 38B.

An axial passage 45 is formed in the rotary shaft 31 and extends in the is direction of the axis L. The rear end of the axial passage 45 is opened at a suction port 45*a* which communicates with the suction chamber 22 through a communication hole 46 which extends through the valve plates 25B, the discharge valve plate 26B and the retainer plate 15B. Incidentally, the discharge chamber 21B is defined annularly around the suction chamber 22 and is located adjacent to the suction chamber 22.

Suction holes 47A are formed in the cylinder block 11A so as to interconnect the cylinder bores 38A and the shaft hole 32A, respectively. Suction holes 47B are formed in the cylinder block 11B so as to interconnect the cylinder bores 38B and the shaft hole 32B, respectively.

Introducing holes 48A, 48B are formed in the rotary shaft 31 for communication with the axial passage 45. The introducing hole 48A of the rotary shaft 31 is formed to correspond with the suction hole 47A of the cylinder block 11A and the introducing hole 48B to the suction hole 47B of the cylinder block 11B, respectively. The introducing holes 48A, 48B intermittently interconnect the axial passage 45 and the suction holes 47A, 47B, respectively, with the rotation of the rotary shaft 31.

When the piston 39 is in a suction cycle in the cylinder bore 38A, the axial passage 45 communicates with the suction hole 47A through the introducing hole 48A. In such a state, the refrigerant gas in the suction chamber 22 is introduced into the compression chamber 40A of the cylinder bore 38A through the communication hole 46, the axial passage 45, the introducing hole 48A and the suction hole 47A.

When the piston 39 is in a compression and discharge cycle, communication between the axial passage 45 and the suction hole 47A is shut. In such a state, the refrigerant gas in the compression chamber 40A is compressed, then the compressed refrigerant gas is discharged into the discharge chamber 21A through the discharge port 27A by pushing away the discharge valve 28A. The refrigerant gas discharged into the discharge chamber 21A flows out to the external refrigerant circuit (not shown) and then returns to the suction chamber 22 of the compressor for recirculation in the refrigerant circuit.

Similarly, when the piston 39 is in a suction cycle in the cylinder bore 38B, the axial passage 45 communicates with the suction hole 47B through the introducing hole 48B. In such a state, the refrigerant gas in the suction chamber 22 is introduced into the compression chamber 40B of the cylinder bore 48B through the communication hole 46, axial passage 45, the introducing hole 48B and the suction hole 47B.

When the piston 39 is in a compression and discharge cycle, communication between the axial passage 45 and the suction hole 47B is shut. In such a state, the refrigerant gas in the compression chamber 40B is compressed, then the compressed refrigerant gas is discharged into the discharge chamber 21B through the discharge port 27B by pushing away the discharge valve 28B. The refrigerant gas discharged into the discharge chamber 21B flows out to the external refrigerant circuit and then returns to the suction chamber 22.

It is noted that gas passage between the suction chamber 22 in the rear housing 14 and the front compression chambers 40A includes the communication hole 46, the axial passage 45, the introducing hole 48A and the suction holes 47A. Similarly, gas passage between the suction chamber 22 and the rear compression chambers 40B includes the communication hole 46, the axial passage 45, the introducing hole 48B and the suction holes 47B. The length in the axial passage 45 for the refrigerant gas to flow to the compression chambers 40A is greater than the length for the refrigerant gas to flow to the compression chambers 40B.

A portion of the rotary shaft 31 surrounded by the shaft hole 32A constitutes a suction valve device 49A and serves as a rotary valve 50A which is integrally formed with the rotary shaft 31. Similarly, a portion of the rotary shaft is 31 surrounded by the shaft hole 32B constitutes a suction valve device 49B and serves as a rotary valve 50B which is integrally formed with the rotary shaft 31. The rotary valves 50A, 50B open and close the gas passages between the corresponding compression chambers 40A, 40B and the suction chamber 22 with rotation of the rotary shaft 31.

Oil feeding passages 51A, 51B are formed in the rotary shaft 31 so as to communicate with the axial passage 45. The oil feeding passages 51A corresponds with the front thrust bearing 37A. The oil feeding passages 51B corresponds with the rear thrust bearing 37B. Lubricating oil separated from the refrigerant gas and stuck on the inner circumferential surface of the axial passage is fed through the oil feeding passages 51A, 51B to the corresponding thrust bearings 37A, 37B with rotation of the rotary shaft 31.

The crank chamber 36 is defined to be isolated from the discharge chamber 21A, 21B and the suction chamber 22. During operation of the compressor when the refrigerant gas is compressed in the compression chambers 40A, 40B, the crank chamber 36 is higher in pressure than the suction chamber 22 and lower in pressure than the discharge chambers 21A, 21B because the refrigerant gas of relatively high pressure leaks from the compression chambers 40A, 40B through gaps between the cylinder bores 38A, 38B and the double-headed piston 39.

An oil introducing passage 52A is formed in the cylinder block 11A for introducing the lubricating oil from the crank chamber 36 into the through hole 33 which accommodates the shaft seal member 34. Similarly, an oil introducing passage 52B is formed in the cylinder block 11B for introducing the lubricating oil from the crank chamber 36 into the suction chamber 22. The oil introducing passage 52B communicates with the suction chamber 22 though a communication hole 55 which extends through the valve port plate 25B, the discharge valve plate 26B and the retainer plate 15B.

Part of the lubricating oil introduced into the through hole 33 is used for lubricating the sliding portion between the shaft seal member 34 and the rotary shaft 31, and the rest of the lubricating oil is introduced into the axial passage 45 through holes 53 which are formed in the rotary shaft 31. The lubricating oil in the suction chamber 22 is introduced into the axial passage 45 through the communication hole 46. The lubricating oil in the axial passage 45 is fed through the introducing holes 48A, 48B for lubrication of the respective cylinder bores 38A, 38B.

Figure 2:
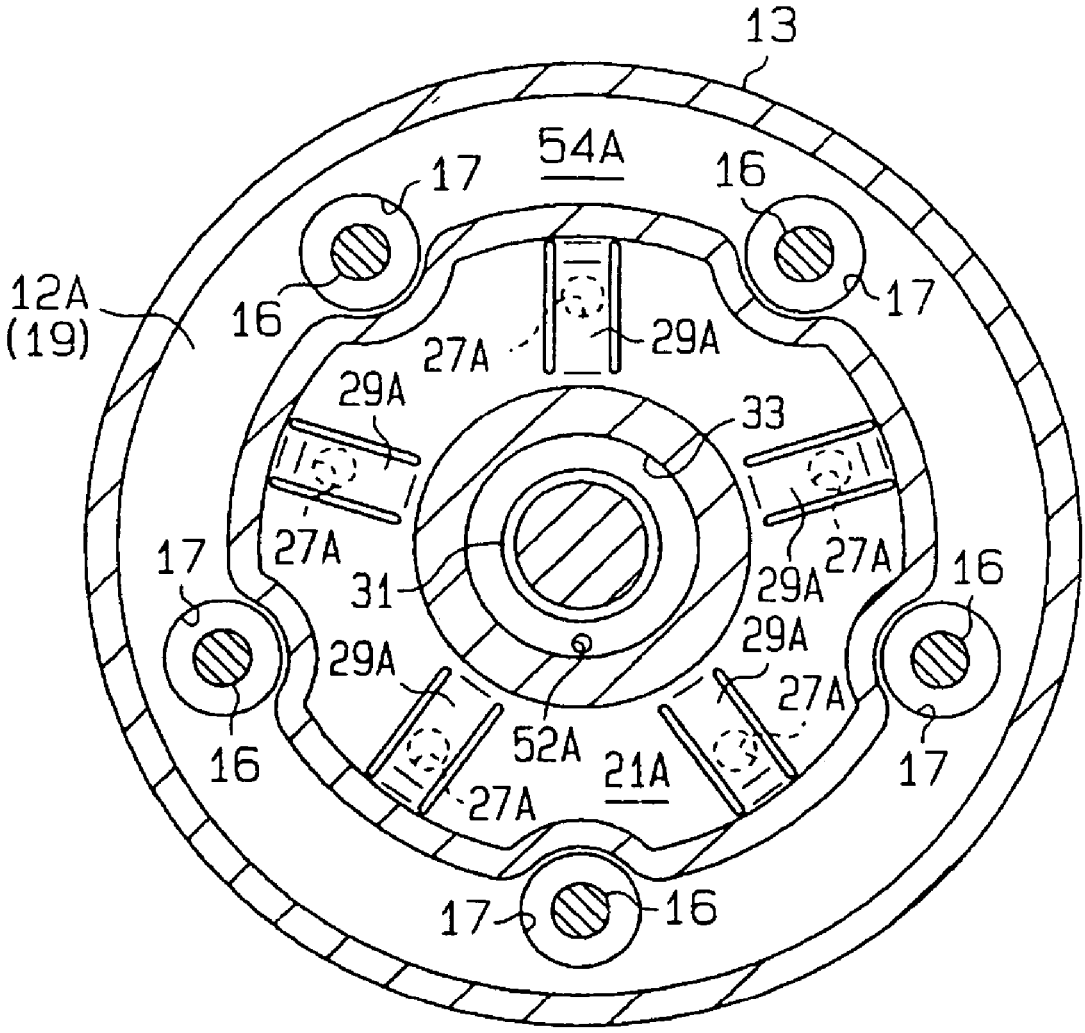
FIG. 2 is a cross-sectional end view that is taken along the line I-I in FIG. 1.

A cooling chamber 54A is defined between the front housing 13 and the retainer plate 15A and is located adjacent to the discharge chamber 21A so as to surround the outer circumference of the discharge chamber 21A, as shown in FIG. 2. The cooling chamber 54A is defined by connecting the front end surface 18A of the retainer plate 15A and the end surface 13*a* of the front housing 13. The seal member 19 provided on the front end surface 18A of the retainer plate 15A seals the inside of the front housing 13 by shutting communication between the cooling chamber 54A and the atmosphere outside the compressor.

Similarly, a cooling chamber 54B is defined between the rear housing 14 and the retainer plate 15B so as to surround the outer circumference of the discharge chamber 21B. The cooling chamber 54B is defined by connecting the rear end surface 18B of the retainer plate 15B and the end surface 14*a* of the rear housing 14. The seal member 19 provided on the rear end surface 18B of the retainer plate 15B seals the inside of the rear housing 14 by shutting communication between the cooling chamber 54B and the atmosphere outside the compressor. The cooling chambers 54A, 54B are isolated from the suction chamber 22.

The cooling chambers 54A, 54B form an endlessly annular shape surrounding their corresponding discharge chambers 21A, 21B. As shown in FIG. 2, the cooling chamber 54A is located between the outer circumference of the front housing 13 and the outer circumference of the discharge chamber 21A. Similarly, the cooling chamber 54B is located between the outer circumference of the rear housing 14 and the outer circumference of the discharge chamber 21B. The cooling chambers 54A, 54B communicate with the crank chamber 36 through a plurality of the through holes 17. The refrigerant gas in the crank chamber 36 flows into the cooling chambers 54A, 54B through clearances between the inner circumferential surfaces of the through holes 17 and the outer circumferential surfaces of the bolts 16. Namely, the clearances serve as introducing passages.

According to the first preferred embodiment, the following advantageous effects are obtained.

(1) The cooling chamber 54A isolated from the suction chamber 22 is defined in the front housing 13 and is located adjacent to the discharge chamber 21A so as to surround the discharge chamber 21A. The seal member 19 provided on the front end surface 18A of the retainer plate 15A seals the inside of the front housing 13 by shutting communication between the cooling chamber 54A and the atmosphere outside the compressor. Similarly, the cooling chamber 54B isolated from the suction chamber 22 is defined in the rear housing 14 and is located adjacent to the discharge chamber 21B so as to surround the discharge chamber 21B. The seal member 19 provided on the rear end surface 18B of the retainer plate 15B seals the inside of the rear housing 14 by shutting communication between the cooling chamber 54B and the atmosphere outside the compressor. Namely, the cooling chambers 54A, 54B are located adjacent to the atmosphere outside the compressor.

Accordingly, the seal member 19 is easily susceptible to heat of the refrigerant gas in the cooling chambers 54A, 54B. Furthermore, the seal member 19 is exposed to the pressure difference between the cooling chambers 54A, 54B and the atmosphere outside the compressor.

In the first preferred embodiment, the cooling chambers 54A, 54B and the crank chamber 36 are interconnected through the introducing passages (the clearances between the inner circumferential surfaces of the through holes 17 and the outer circumferential surfaces of the bolts 16). Accordingly, the refrigerant gas in the crank chamber 36 which is lower in both temperature and pressure than the refrigerant gas in the discharge chambers 21A, 21B is introduced into the cooling chambers 54A, 54B. Thus, a thermal load on the seal member 19 and a load thereon due to the pressure difference between the cooling chambers 54A, 54B and the atmosphere outside the compressor is reduced with the result that durability of the seal member 19 is improved.

(2) The cooling chambers 54A, 54B and the crank chamber 36 are interconnected through a plurality of the introducing passages (the clearances between the inner circumferential surfaces of the through holes 17 and the outer circumferential surfaces of the bolts 16). Accordingly, providing a plurality of the introducing passages facilitates circulation of the refrigerant gas between the cooling chambers 54A, 54B and the crank chamber 36. Thus, the temperature rise in the cooling chambers 54A, 54B due to the stagnant refrigerant gas in the cooling chambers 54A, 54B is avoided, so that a thermal load on the seal member 19 is further reduced.

(3) The clearances between the inner circumferential surfaces of the through holes 17 and the outer circumferential surfaces of the bolts 16 are utilized as the introducing passages in the first preferred embodiment. Thus, an extra manufacturing process for providing the introducing passages is omitted and the manufacturing cost is reduced.

(4) The cooling chambers 54A, 54B form an endless annular shape surrounding the corresponding discharge chambers 21A, 21B, so that the refrigerant gas flows smoothly along the above annular passages in the respective cooling chambers 54A, 54B. Thus, part of the cooling chambers 54A, 54B will not be heated excessively by stagnant refrigerant gas, so that a thermal load caused by the refrigerant gas in the cooling chambers 54A, 54B is uniformly applied to the entire sealing region of the seal member 19. As a result, the seal member 19 can maintain its sealing performance over the entire sealing region without being influenced by the thermal load.

(5) The length in the axial passage 45 for the refrigerant gas to flow from the suction chamber 22 to the compression chambers 40A is greater than that for the gas to flow to the compression chambers 40B. Namely, the compression chambers 40A are located farther from the suction chamber 22 than the compression chambers 40B. Accordingly, as mentioned above, the compression ratio in the front compression chambers 40A tends to increase because of the shortage of refrigerant gas, so that the temperature of refrigerant gas discharged to the discharge chamber 21A rises as compared with the refrigerant gas discharged from the rear compression chambers 40B to the discharge chamber 21B.

In the first preferred embodiment, however, providing the cooling chamber 54A in the front housing 13 helps to prevent the seal member 19 provided on the front end surface 18A of the retainer plate 15A from being exposed to the high temperature and high pressure refrigerant gas in the discharge chamber 21A. Accordingly, a load on the seal member 19 due to heat and pressure difference is reduced, so that durability of the seal member 19 is improved.

This advantage is effective particularly in the first preferred embodiment in which the suction chamber 22 is provided only in the rear housing 14 and the suction valve devices 49A, 49B are provided by the rotary valves 50A, 50B, that is, the distance for the refrigerant gas to flow from the suction chamber 22 to the front compression chambers 40A and to the rear compression chambers 40B are different.

Figures 3, 3A:
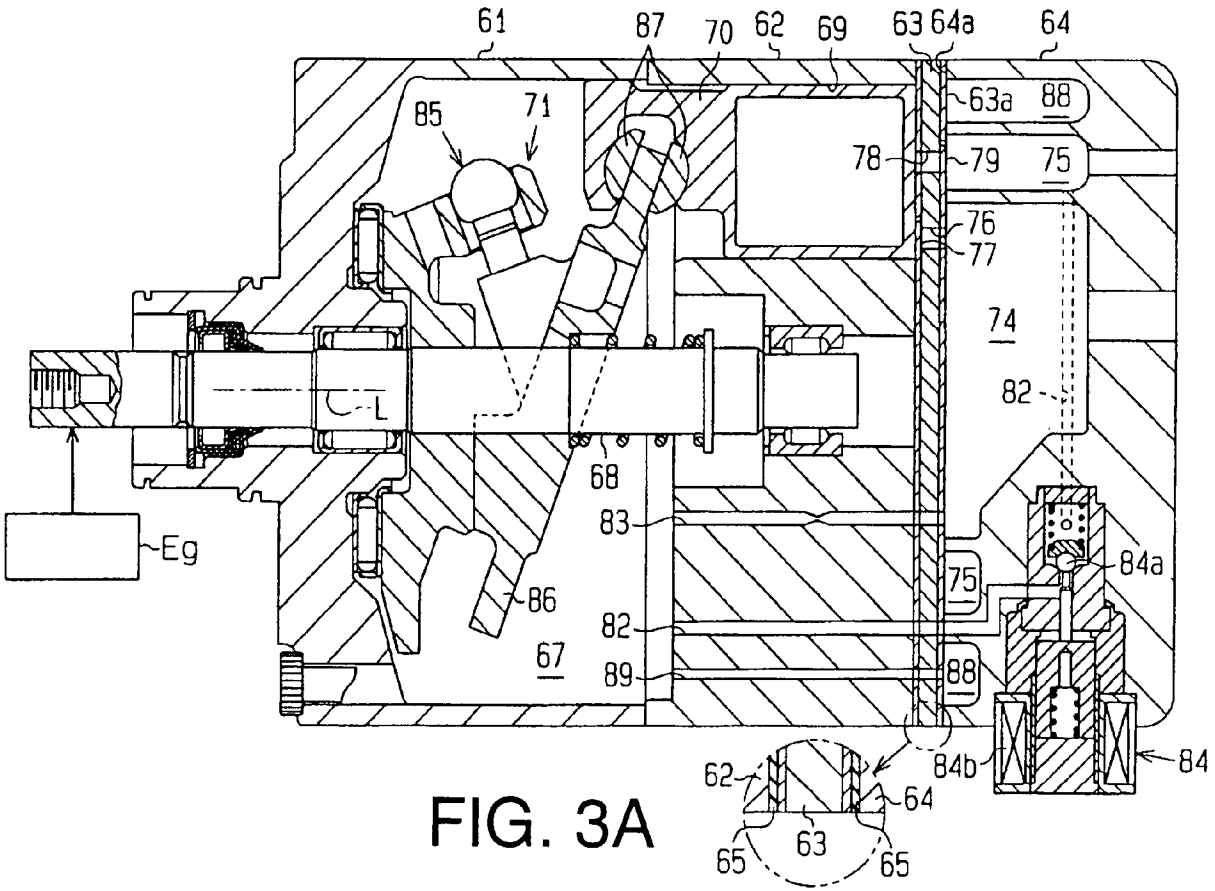
FIG. 3 is a schematic longitudinal cross-sectional view of a piston type compressor according to a second preferred embodiment of the present invention.
FIG. 3A is a partially enlarged cross-sectional view of FIG. 3.

A second preferred embodiment of the present invention will now be described with reference to FIGS. 3 and 3A. The present invention applies a variable displacement single-headed piston type compressor to the second preferred embodiment. The left and right sides of the compressor correspond to the front and rear sides in FIG. 3, respectively.

In the second preferred embodiment, a housing of the compressor includes a front housing 61, a cylinder block 62, a valve port assembly 63 and a rear housing (a cylinder head) 64, which are housing components. A crank chamber 67 is defined between the front housing 61 and the cylinder block 62. A rotary shaft 68 is rotatably supported by the front housing 61 and the cylinder block 62, and extends through the crank chamber 67. The rotary shaft 68 is operatively coupled to the engine Eg.

A plurality of cylinder bores 69 (only one being shown in FIG. 3) is defined in the cylinder block 62 around the axis L of the rotary shaft 68. A single-headed piston 70 is accommodated in each of the cylinder bores 69. A space defined in each of the cylinder bores 69 between the piston 70 and the valve port assembly 63 serves as a compression chamber. A crank mechanism 71 including a cam (a swash plate 86) is accommodated in the crank chamber 67 for converting the rotation of the rotary shaft 68 into the reciprocation of the piston 70.

A suction chamber 74 and a discharge chamber 75 are defined in the rear housing 64. The suction chamber 74 and the discharge chamber 75 are defined by connecting the rear end surface 63*a* of the valve port assembly 63 and a front end surface 64*a* of the rear housing 64. The discharge chamber 75 forms an annular shape and is located adjacent to and around the suction chamber 74 which is located substantially at the center of the rear housing 64.

It is noted that seal members 65 are provided on the front and rear surfaces of the valve port assembly 63, respectively, for sealing a slight clearance between the end surface of the cylinder block 62 and the front surface of the valve port assembly 63 and between the adjacent end surface of the rear housing 14 and the rear surface of the valve port assembly 63.

The refrigerant gas in the suction chamber 74 is introduced into each cylinder bore 69 through a suction port 76 by pushing away a suction valve 77 as the piston 70 moves from the top dead center to the bottom dead center. The suction ports 76 and the suction valves 77 are formed in the valve port assembly 63. The refrigerant gas introduced in the cylinder bore 69 is compressed up to a predetermined pressure and then discharged into the discharge chamber 75 through a discharge port 78 by pushing away a discharge valve 79 as the piston 70 moves from the bottom dead center to the top dead center. The discharge ports 78 and the discharge valves 79 are formed in the valve port assembly 63. Incidentally, retainers for regulating the opening of the discharge valves 79 are not shown in FIG. 3.

The compressor of the second preferred embodiment is configured to vary the stroke of the pistons 70, that is, the displacement of the compressor. For this purpose, a supply passage 82 is provided for communication between the discharge chamber 75 and the crank chamber 67, and a bleed passage 83 is provided for communication between the crank chamber 67 and the suction chamber 74. A control valve 84 such as electromagnetic valve is arranged in the supply passage 82. The control valve 84 includes a valve body 84*a* which opens and closes the supply passage 82 and a solenoid 84*b* which controls the operation of the valve body 84*a*.

The control valve 84 is operable to vary the opening of the supply passage 82, thereby varying the amount of high pressure refrigerant gas introduced into the crank chamber 67.

Pressure in the crank chamber 67 (the crank pressure) is varied depending on the amount of high pressure refrigerant gas introduced into the crank chamber 67, the amount of refrigerant gas leaked from the cylinder bores 69 into the crank chamber 67 and the amount of refrigerant gas flowing to the suction chamber 74 through the bleed passage 83. In other words, the control valve 84 varies the pressure in the crank chamber 67 in the range between the pressure in the suction chamber 74 and the pressure in the discharge chamber 75.

The crank mechanism 71 has the swash plate (the cam) 86 that is operatively coupled to a hinge mechanism 85 in such a manner that the swash plate 86 is integrally rotatable with the rotary shaft 68 and also inclinable relative to the rotary shaft 68. In operation, as the crank pressure is varied, the pressure difference between the crank pressure and pressure in the cylinder bore 69 through the pistons 70 is changed, and the inclination angle of the swash plate 86 is varied, accordingly. The outer peripheral portion of the swash plate 86 is operatively coupled to the pistons 70 through a pair of shoes 87. As a result of variation in the inclination angle of the swash plate 86, the stroke of the pistons 70 is varied, so that the displacement of the compressor is adjusted.

To be more specific, the inclination angle of the swash plate 86 is reduced with an increase of the crank pressure and the displacement of the compressor is reduced, accordingly. On the contrary, as the crank pressure is reduced, the inclination angle of the swash plate 86 is increased, so that the displacement of the compressor is increased.

A cooling chamber 88 is defined between the valve port assembly 63 and the rear housing 64 so as to surround the discharge chamber 75. The cooling chamber 88 is defined by connecting the rear end surface 63*a* of the valve port assembly 63 and the front end surface 64*a* of the rear housing 64. The seal member 65 provided on the rear end surface of the valve port assembly 63 seals the inside of the rear housing 64 by shutting communication between the cooling chamber 88 and the atmosphere outside the compressor. The cooing chamber 88 is isolated from the suction chamber 74.

The cooling chamber 88 forms an endlessly annular shape around the discharge chamber 75. The cooling chamber 88 communicates with the crank chamber 67 through a plurality of introducing passages 89 (only one being shown in FIG. 3) which are formed around the axis L of the rotary shaft 68 so as to extend through the cylinder block 62 and the valve port assembly 63.

In the second preferred embodiment, the control valve 84 varies the pressure in the crank chamber 67 in the range between the pressure in the suction chamber 74, which is greater than that of the atmosphere outside the compressor, and the pressure in the discharge chamber 75. Accordingly, the pressure in the crank chamber 67 is maintained lower than that in the discharge chamber 75 unless the pressure in the crank chamber 67 is increased substantially to the pressure in the discharge chamber 75 by the control valve 84.

As is apparent from the foregoing description, in the second preferred embodiment, as well as the first preferred embodiment, since the cooling chamber 88 is defined so as to surround the discharge chamber 75 and is also located adjacent to the discharge chamber 75 and the atmosphere outside the compressor, a thermal load on the seal member 65 and a load on the seal member 65 due to the pressure difference between the cooling chamber 88 and the atmosphere outside the compressor are reduced. Accordingly, durability of the seal member 65 is improved.

According to the second preferred embodiment, in addition to the above described advantageous effects, the advantageous effects mentioned in the paragraphs (2) and (4) with reference to the first preferred embodiment are obtained.

The present invention is not limited to the embodiments described above but may be modified into the following alternative embodiments.

In the first preferred embodiment, the suction valve devices 49A, 49B include the rotary valves 50A, 50B, respectively. In an alternative embodiment, a suction valve device including a reed valve is employed.

Figures 4, 4A:
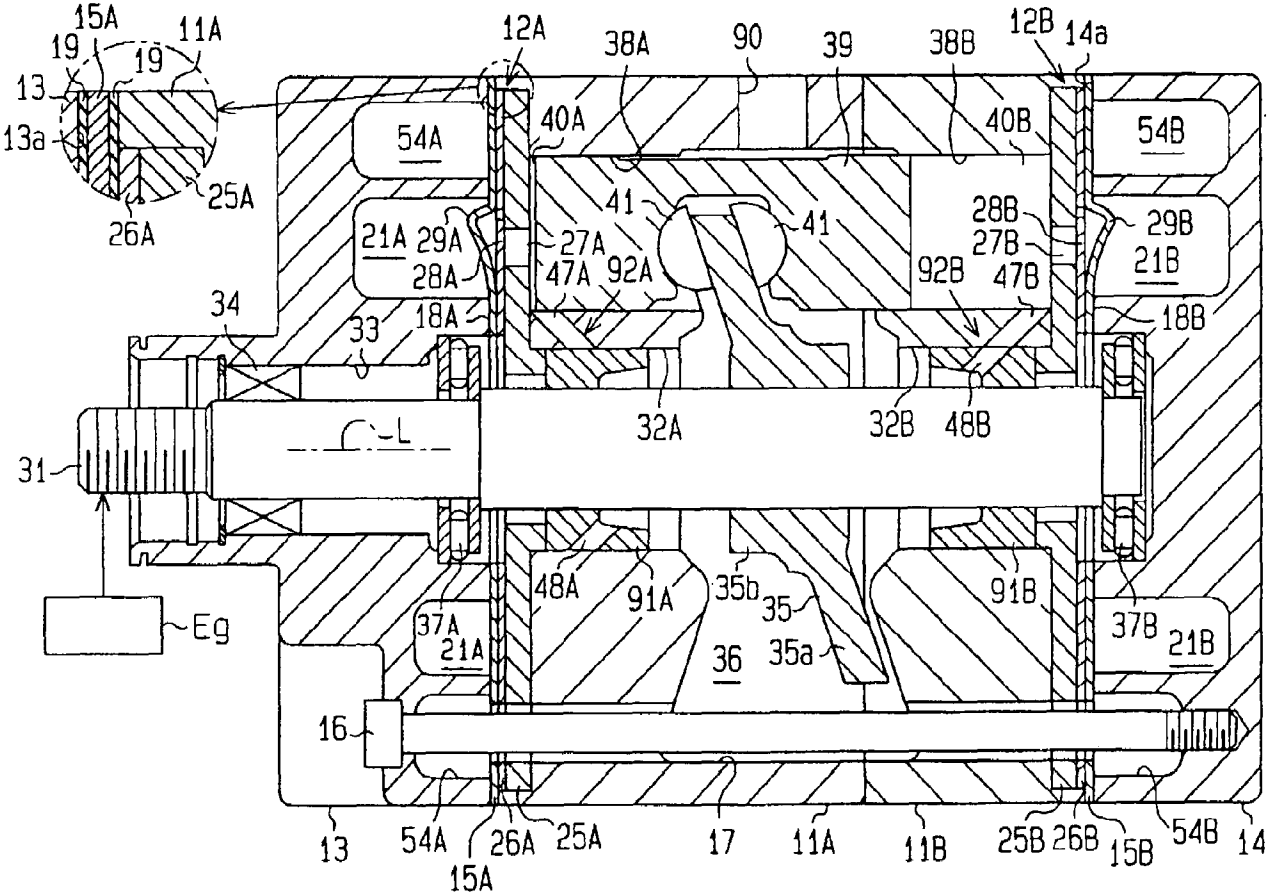
FIG. 4 is a schematic longitudinal cross-sectional view of a piston type compressor according to an alternative embodiment of the present invention.
FIG. 4A is a partially enlarged cross-sectional view of FIG. 4.
Figure 5:
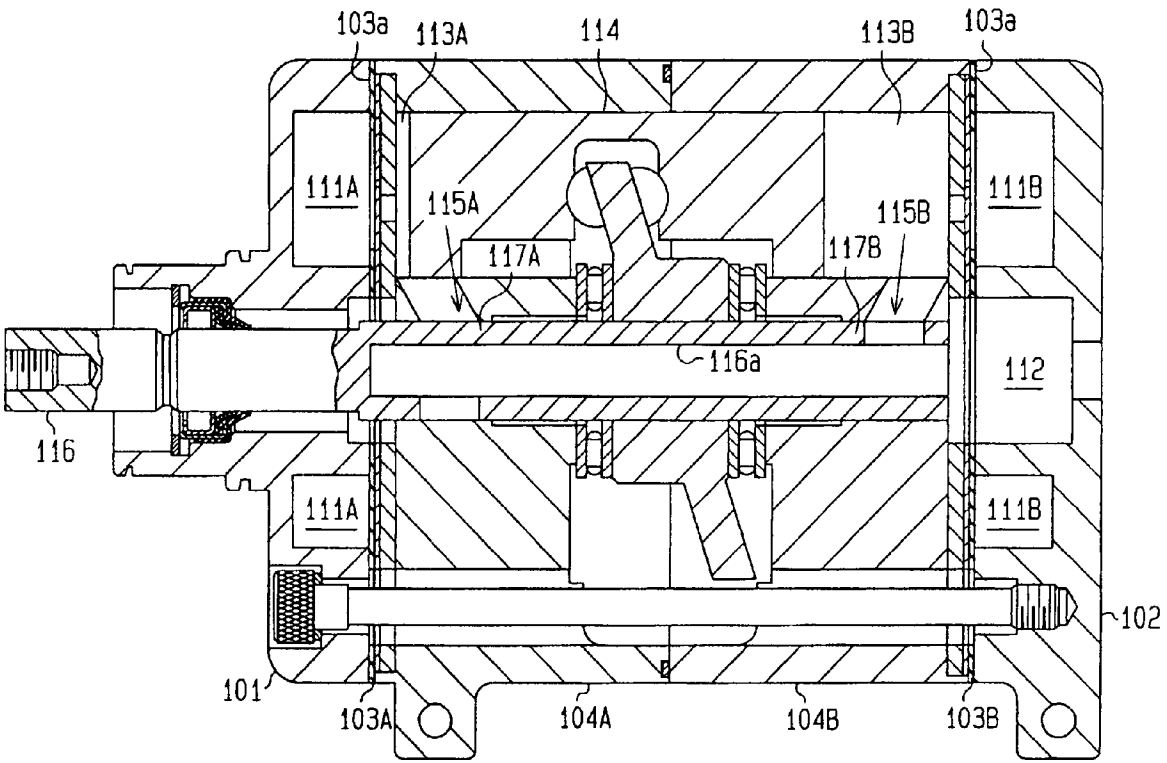
FIG. 5 (PRIOR ART)
FIG. 5 is a schematic longitudinal cross-sectional view of a piston type compressor according to a prior art.

In the first preferred embodiment, the suction chamber 22 is defined in the rear housing 14 so as to be isolated from the crank chamber 36, and the refrigerant gas is introduced into the compression chambers 40A, 40B through the suction chamber 22. In an alternative embodiment, it is so arranged that the crank chamber 36 doubles as a suction chamber into which the refrigerant gas is drawn from the external refrigerant circuit and then introduced from the crank chamber 36 into the compression chambers 40A, 40B without passing through the rear housing 14. For achieving such alternative arrangement, the structure as shown in FIGS. 4 and 4A is employed. Incidentally, the same reference numerals in FIGS. 4 and 4A denote the components similar to those of the first preferred embodiment.

As shown in FIG. 4, a communication hole 90 is formed in the cylinder block 11A for introducing the refrigerant gas from the external refrigerant circuit directly into the crank chamber 36. The structure of this alternative embodiment differs from that of the first preferred embodiment in that it does not include the suction chamber 22 which is defined in the rear housing 14 of the first preferred embodiment.

Substantially cylindrical rotary valves 91A, 91B, each of which has an opening at one end, are fixedly connected to the rotary shaft 31. The rotary valve 91A serves as a suction valve device 92A for the front compression chambers 40A and the rotary valve 91B serves as a suction valve device 92B for the rear compression chambers 40B.

The rotary valves 91A, 91B are accommodated in the shaft holes 32A, 32B, respectively, so as to be slidably rotatable. The introducing holes 48A, 48B are formed in the rotary valves 91A, 91B, respectively, and communicate with the crank chamber 36. The introducing holes 48A, 48B intermittently interconnect the crank chamber 36 and the suction holes 47A, 47B, respectively, with the rotation of the rotary shaft 31. The refrigerant gas in the crank chamber 36 is introduced into the compression chambers 40A, 40B during the suction stoke through the introducing holes 48A, 48B, respectively.

According to this alternative embodiment, in comparison to a structure in which the refrigerant gas drawn from the external refrigerant circuit into the crank chamber 36 is introduced into the compression chambers 40A, 40B through any passage in the cylinder head, the length of a path along which the refrigerant gas flows from the crank chamber 36 to the compression chambers 40A, 40B is is easily shortened.

It is noted that since the crank chamber 36 doubles as a suction chamber, the pressure in the suction chamber tends to be higher than the pressure in a suction chamber that is isolated from the crank chamber 36, due to blow-by gas and the like leaked from the compression chambers 40A, 40B. Accordingly, the pressures in the cooling chambers 54A, 54B which communicate with the crank chamber 36 are easily approximated to the pressures in the discharge chambers 21A, 21B, so that a load on the seal member 19 due to the pressure difference between the cooling chambers 54A, 54B and the discharge chambers 21A, 21B is easily reduced.

In the first preferred embodiment, the introducing passage is formed by the clearances between the inner circumferential surfaces of the through holes 17 and the outer circumferential surfaces of the bolts 16. The introducing passages are not limited to such structure. In an alternative embodiment, the introducing passage for communication between the crank chamber 36 and the respective cooling chambers 54A, 54B is separately formed from the through holes 17.

In an alternative embodiment to the first preferred embodiment, either one of the cooling chambers 54A, 54B is omitted.

In an alternative embodiment to the second preferred embodiment, the introducing passage 89 may be omitted and the cooling chamber 88 may be located in the supply passage 82 between the control valve 84 and the crank chamber 67. When a potion of the supply passage 82 adjacent to the valve body 84*a* of the control valve 84 is configured so as to serve as a throttle, the pressure in the supply passage 82 downstream of the control valve 84 may be substantially the same as the crank pressure. In this case, the pressure in the cooling chamber 88 provided downstream of the control valve 84 in the supply passage 82 becomes the pressure corresponding to the crank pressure. In this alternative embodiment, the supply passage 82 downstream of the cooling chamber 88 serves as an introducing passage.

In an alternative embodiment to the preferred embodiments, the cooling chambers 54A, 54B, 88 are not limited to an endlessly annular shape.

In an alternative embodiment to the preferred embodiments, only one introducing passage may be formed.

It is noted that the present invention is applicable also to a variable displacement wobble type compressor and to a wave cam piston type compressor which employs a wave cam as a cam instead of a swash plate.

Therefore, the present examples and embodiments are to be considered as illustrative and not restrictive, and the invention is not to be limited to the details given herein but may be modified within the scope of the appended claims.

What is claimed is:

1. A piston type compressor comprising:

a housing including a cylinder head which defines a discharge chamber and a cooling chamber, the cooling chamber being located adjacent to and surrounding the discharge chamber, the housing defining a suction chamber, a compression chamber, and a crank chamber, the cooling chamber being isolated from the suction chamber, gas being introduced from an outside of the housing into the suction chamber;

a rotary shaft rotatably supported by the housing;

a cam accommodated in the crank chamber;

a piston operatively coupled to the rotary shaft through the cam, wherein rotation of the rotary shaft is converted to reciprocation of the piston;

a seal member shutting communication between the cooling chamber and an atmosphere outside the compressor to seal an inside of the cylinder head; and an introducing passage interconnecting the cooling chamber and the crank chamber.

2. The piston type compressor according to claim 1, wherein a plurality of the introducing passages interconnects the cooling chamber and the crank chamber.

3. The piston type compressor according to claim 1, wherein the housing further includes a housing component, a through hole being formed in the housing for inserting a bolt which fastens the housing component to the cylinder head, a clearance between an inner circumferential surface of the through hole and an outer circumferential surface of the bolt serving as the introducing passage.

4. The piston type compressor according to claim 1, wherein the cooling chamber forms an annular shape around the discharge chamber.

5. The piston type compressor according to claim 4, wherein the cooling chamber forms an endlessly annular shape.

6. The piston type compressor according to claim 1, wherein the housing has a first end and a second end, the piston of a double-headed type defining the first and second compression chambers which are respectively located on the first end side of the housing and on the second end side of the housing, the cylinder head including a pair of first and second cylinder heads which is 20 respectively located on the first end and on the second end, the discharge chamber including a first discharge chamber and a second discharge chamber, the first cylinder head defining the first discharge chamber, the second cylinder head defining the suction chamber and the second discharge chamber, the suction chamber in the second cylinder head communicating with the first compression chamber through a suction passage, the gas from an external circuit being introduced into the second compression chamber through the suction chamber in the second cylinder head and being introduced into the first compression chamber through the suction chamber in the second cylinder head and the suction passage, the cooling chamber being at least formed in the first cylinder head.

7. The piston type compressor according to claim 6, wherein the second discharge chamber in the second cylinder head is formed to surround an outer circumference of the suction chamber, a gas passage interconnecting the first and second compression chambers and the suction chamber, wherein the compressor further comprising:

a pair of suction valve devices respectively applied for the first and the second compression chambers, rotary valves serving as the suction valve devices for opening and closing the gas passage as the rotary valves rotate integrally with the rotary shaft, wherein an axial passage is formed in the rotary shaft, a portion of the suction passage which constitutes the gas passage being formed by the axial passage.

8. The piston type compressor according to claim 7, wherein the rotary valves are integrally formed with the rotary shaft.

9. The piston type compressor according to claim 7, wherein the rotary valves are separately formed from the rotary shaft.

10. The piston type compressor according to claim 1, wherein the crank chamber doubles as the suction chamber, the gas from the outside of the housing being introduced into the compression chamber without passing through the cylinder head.

11. The piston type compressor according to claim 1, wherein the cooling chamber is located between an outer circumference of the cylinder head and the outer circumference of the discharge chamber.

12. The piston type compressor according to claim 1, wherein the piston is a double-headed type.

13. The piston type compressor according to claim 1, wherein the piston is a single-headed type.

14. The piston type compressor according to claim 1, wherein the compressor is a variable displacement type.

* * * * *